US005158440A

United States Patent [19]

Cooper et al.

[11] Patent Number: 5,158,440

[45] Date of Patent: Oct. 27, 1992

[54] INTEGRATED CENTRIFUGAL PUMP AND MOTOR

[75] Inventors: Paul Cooper, Titusville, N.J.; Lee J. Bulson, Riegelsville, Pa.

[73] Assignee: Ingersoll-Rand Company, Woodcliff Lake, N.J.

[21] Appl. No.: 793,237

[22] Filed: Nov. 8, 1991

Related U.S. Application Data

[63] Continuation of Ser. No. 593,655, Oct. 4, 1990.

[51] Int. Cl.[5] ..... F04B 17/00; F04B 35/04

[52] U.S. Cl. ..... 417/423.1; 417/355

[58] Field of Search ..... 417/423.1, 423.12, 423.4, 417/355, 356; 415/93, 97, 101, 102, 103, 120, 228, 900; 416/223 B, 189

[56] References Cited

U.S. PATENT DOCUMENTS

| | | | |
|---|---|---|---|
| 1,586,978 | 1/1926 | Dorer . | |
| 2,700,343 | 1/1955 | Pezzillo . | |
| 3,347,168 | 10/1967 | Nixon . | |
| 3,460,748 | 8/1969 | Erwin | 415/208.3 |
| 3,572,981 | 3/1971 | Pearson et al. . | |
| 3,838,947 | 10/1974 | Laing . | |
| 3,846,050 | 11/1974 | Laing . | |
| 4,035,108 | 7/1977 | Laing . | |
| 4,115,040 | 9/1978 | Knorr . | |
| 4,352,646 | 10/1982 | Laing et al. . | |
| 4,375,937 | 3/1983 | Cooper | 415/53 R |
| 4,375,938 | 3/1983 | Dussourd | 415/53 R |
| 4,398,773 | 8/1983 | Boden et al. | 308/10 |
| 4,644,202 | 2/1987 | Kroy et al. . | |
| 4,644,207 | 2/1987 | Catterfeld et al. . | |
| 4,688,998 | 8/1987 | Olsen et al. | 415/900 |
| 4,780,066 | 10/1988 | Bolleter et al. . | |

FOREIGN PATENT DOCUMENTS

| | | |
|---|---|---|
| 0378251 | 7/1990 | European Pat. Off. . |
| 3905278 | 9/1989 | Fed. Rep. of Germany . |
| 591315 | 7/1925 | France . |
| 63-302198 | 4/1989 | Japan . |
| PCT/US80/-00191 | 3/1979 | PCT Int'l Appl. . |
| 582036 | 11/1946 | United Kingdom . |

*Primary Examiner*—Richard A. Bertsch
*Assistant Examiner*—Alfred Basichas
*Attorney, Agent, or Firm*—Robert F. Palermo; James R. Bell; Michael H. Minns

[57] ABSTRACT

An integrated centrifugal pump and motor is provided by an impeller disk which contains permanent magnets and functions as the rotor for a brushless DC motor. The rotor is supported by non-contacting radial bearings and is hydrodynamically balanced against any axial thrust so that there is no contact between rotating and stationary elements during operation. Since the impeller disk is also the motor rotor, there is no need for a shaft, in the ordinary sense, which would penetrate the case and, thus, require seals. The resulting pump is compact and can be operated electronically at variable speeds.

4 Claims, 3 Drawing Sheets

INTEGRATED CENTRIFUGAL PUMP AND MOTOR

This application is a continuation of application Ser. No. 593,655, filed Oct. 4, 1990.

BACKGROUND OF THE INVENTION

This invention relates generally to electrically driven fluid pumps, and more particularly to electrically driven centrifugal pumps which require no shaft seals.

Centrifugal fluid pumps are well known in the hydraulic and pneumatic fields. They commonly consist of a motor to drive a shaft on which a fluid impeller is mounted. Generally, the fluid inlet port, or suction port, feeds fluid to the center, or hub, of the impeller. A number of impeller vanes generally project outward from the hub in spiral paths and are supported between shrouds which, together with the vanes, define pumping channels. The rotor is encased in a housing which channels the working fluid from the inlet port to the hub, or inducer, where it is inducted into the pumping channels between the vanes and shrouds. The centrifugal action of the impeller drives the working fluid outward to a diffuser at the periphery of the impeller disk where it enters a scroll shaped volute and, from there, is channelled to the discharge port of the pump.

The motor shaft, which supports the impeller, requires bearings which are sometimes lubricated by the working fluid, but, in many cases, they require separate lubrication due to incompatibility of the working fluid. In all cases, seals are required to prevent leakage of the working fluid around the impeller shaft where it enters the pump housing. After some time in service, the bearings may deteriorate to the point where they permit some radial displacement of the rotating shaft. This causes accelerated wear and deterioration of the shaft seal and results in leakage of the working fluid from the pump housing.

The foregoing illustrates limitations known to exist in present centrifugal pumps. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing an impeller disk which also functions as a rotor for a brushless DC motor in a centrifugal fluid pump, comprising a hub section; at least one disk shaped shroud containing permanent magnets; a plurality of impeller blades projecting outward from the hub and fixed to a face of the shroud to define fluid pumping channels; and means for supplying fluid to the pumping channels. The pump including the impeller disk exhibits a novel construction in that the hub section includes inducer means for inducing fluid flow from one or more inlets to the pumping channels through openings in stator coils and the impeller disks. The impeller may be axially hydrodynamically balanced by providing rings for partially closing the gaps between the stator coils and the impeller so that a pressure is established in the gaps.

The foregoing and other aspects will become apparent from the following detailed description of the invention when considered in conjunction with the accompanying drawing figures.

DETAILED DESCRIPTION

Figure 1:
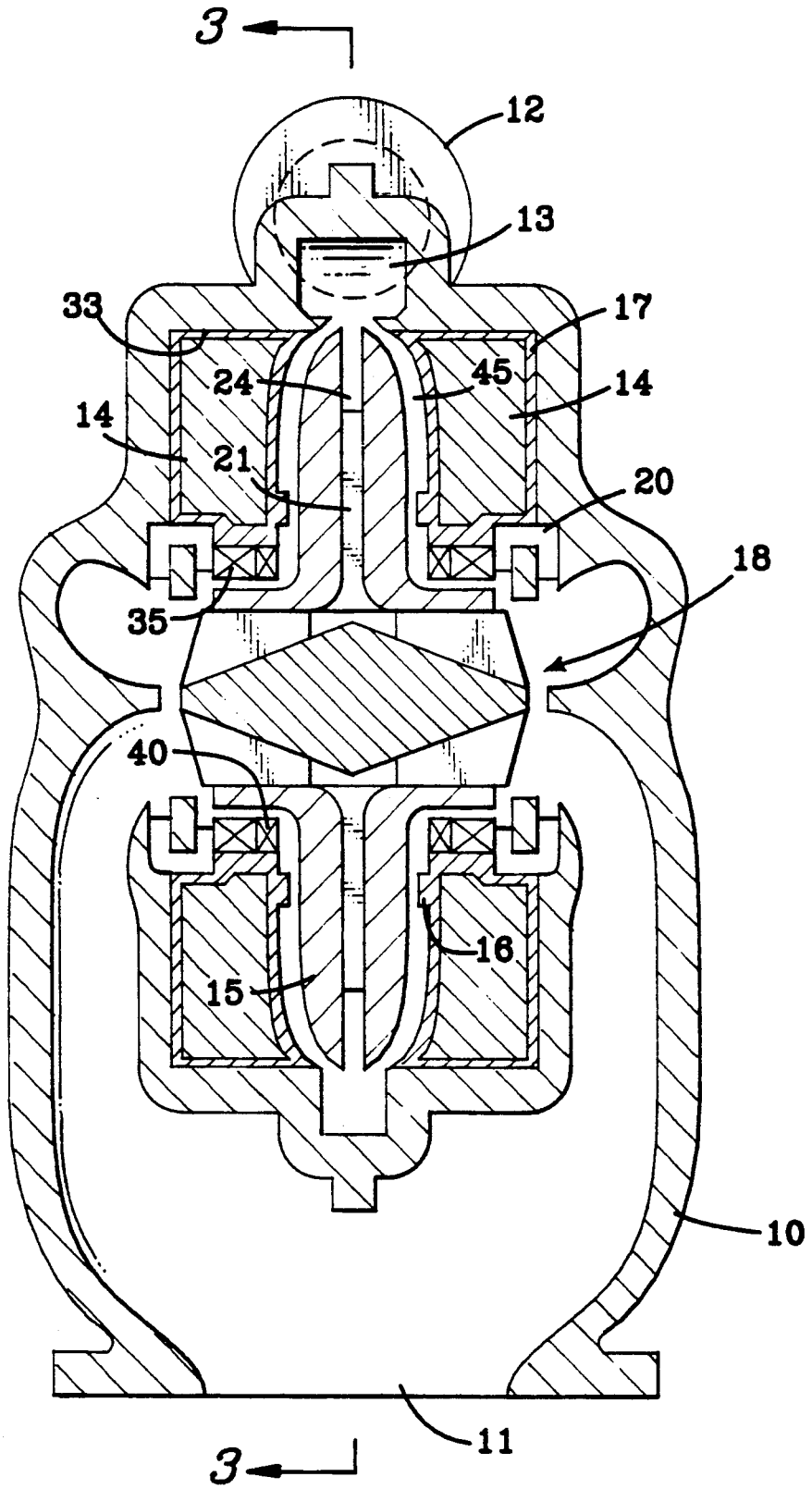
FIG. 1 is a schematic sectional elevation view illustrating one embodiment of a centrifugal pump according to the present invention.

FIG. 1 is a schematic cross sectional view of one embodiment of the pump of the present invention, which is seen to be laterally symmetrical about the vertical center plane represented by the centerline of FIG. 1. The housing 10 has an inlet port 11 and a discharge port 12 which are connected by means of inducer assembly 18, impeller shrouds 15, rotating vaneless diffuser 24, and volute 13. The pump fluid enters at the inlet port 11; divides and passes into the two sides of the inducer assembly 18; passes between the two impeller shrouds 15 through pumping channels 55 (shown in FIG. 3) which are defined by the spaces between neighboring impeller blades 21 and the impeller shrouds 15, between which the impeller blades 21 are disposed; passes through the rotating vaneless diffuser 24; then passes through the volute 13 and into discharge port 12. Between diffuser 24 and volute 13 a small amount of the high pressure fluid feeds back through axial thrust balance passages 45. These narrow passages provide the gap necessary for rotation of the rotor shrouds 15 between the stators 14 and, by admission of the feedback fluid, provide a hydrodynamic balance to counteract any axial thrusts of the rotor 15 so that it remains centered between stators 14. Axial thrust balancing rings 16 are provided in the balance passage 45 either on the surface of the stator can 17 or on a projection of housing 10. By narrowing the axial gap between the impeller shrouds 15 and stator cans 17 or housing 10, these rings cause an increase of fluid pressure in the balance passage 45 which enhances the axial thrust balance performance.

The alternative provided for placement of the axial thrust balancing rings 16 is required because, in some cases, stators 14 will not be canned or encapsulated. In such cases, it is necessary to place the axial thrust balancing rings 16 on projections of housing 10. Each half of housing 10 has a toroidal recess 33 in which a stator 14 is secured. In addition, recirculation passages 20 are provided to assure smooth inducer action at off-design flow rates.

The rotor assembly which includes inducer assembly 18, shrouds 15, impeller blades 21, and rotating diffuser 24 is supported on journals provided on the outside of the tubular axial extensions of shrouds 15 in radial magnetic bearings 35 and auxiliary bearings 40. During operation, the rotor is supported by the radial magnetic bearings 35 which have a large enough clearance to provide non-contact bearing support to the rotor. Should the magnetic bearings 35 fail to support the rotor, auxiliary bearings 40 are provided for the ensuing emergency rundown of the rotor only, and they have a smaller clearance than do magnetic bearings 35.

Impeller shrouds 15 each contain a peripheral array of permanent magnets required for a rotor in a brushless DC motor when used in conjunction with stators 14 containing the windings and electrical connections required for operation as a motor. Because impeller shrouds 15 contain permanent magnets, and because shrouds 15 are supported in radial magnetic bearings 35 and auxiliary bearings 40, there is no need for any shaft to penetrate the housing 10 and, thus, no need for rotary shaft seals which can cause wear of the shaft and will eventually leak.

Figure 2:
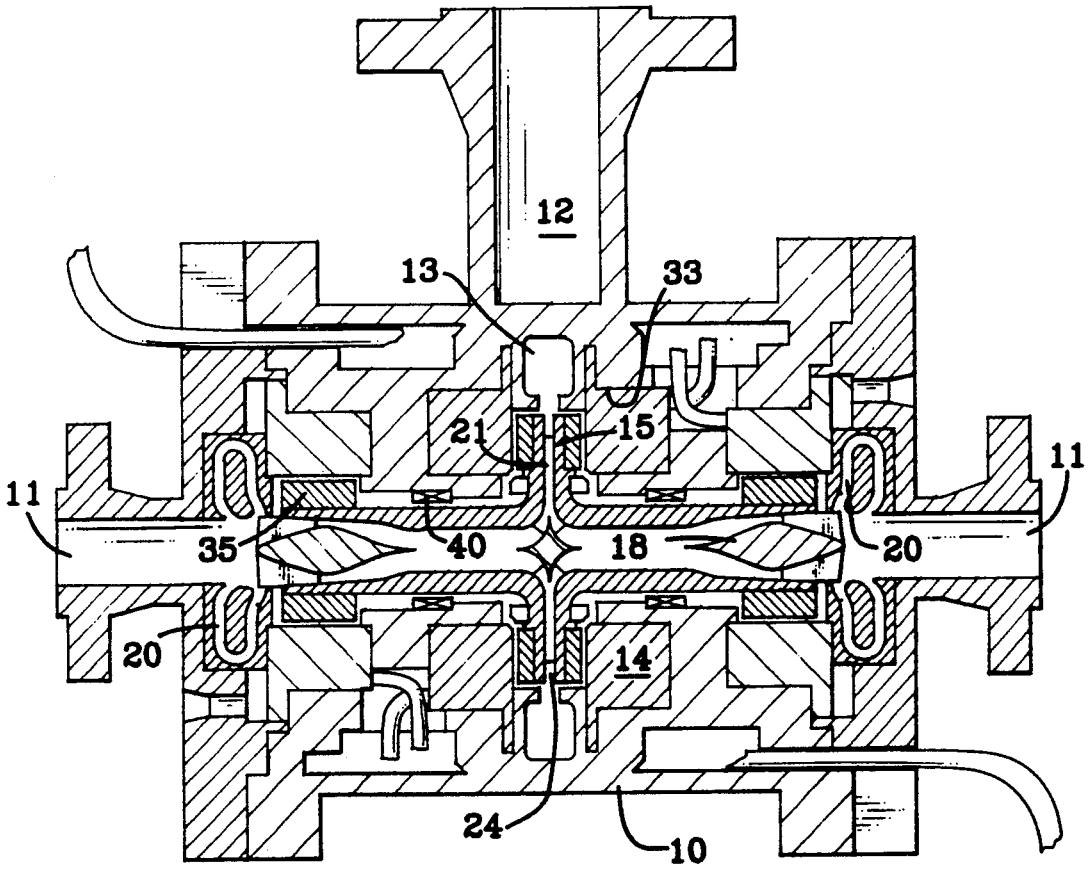
FIG. 2 is a schematic sectional elevation view of another embodiment of the pump of the present invention.

FIG. 2 illustrates another embodiment of the pump of the present invention. In this case the housing 10 is composed of several sections, and it has two inlets 11. Otherwise, in all other respects, the pumps are functionally identical. For this reason, numbering of the various components has been retained consistent with that used in FIG. 1.

Figure 3:
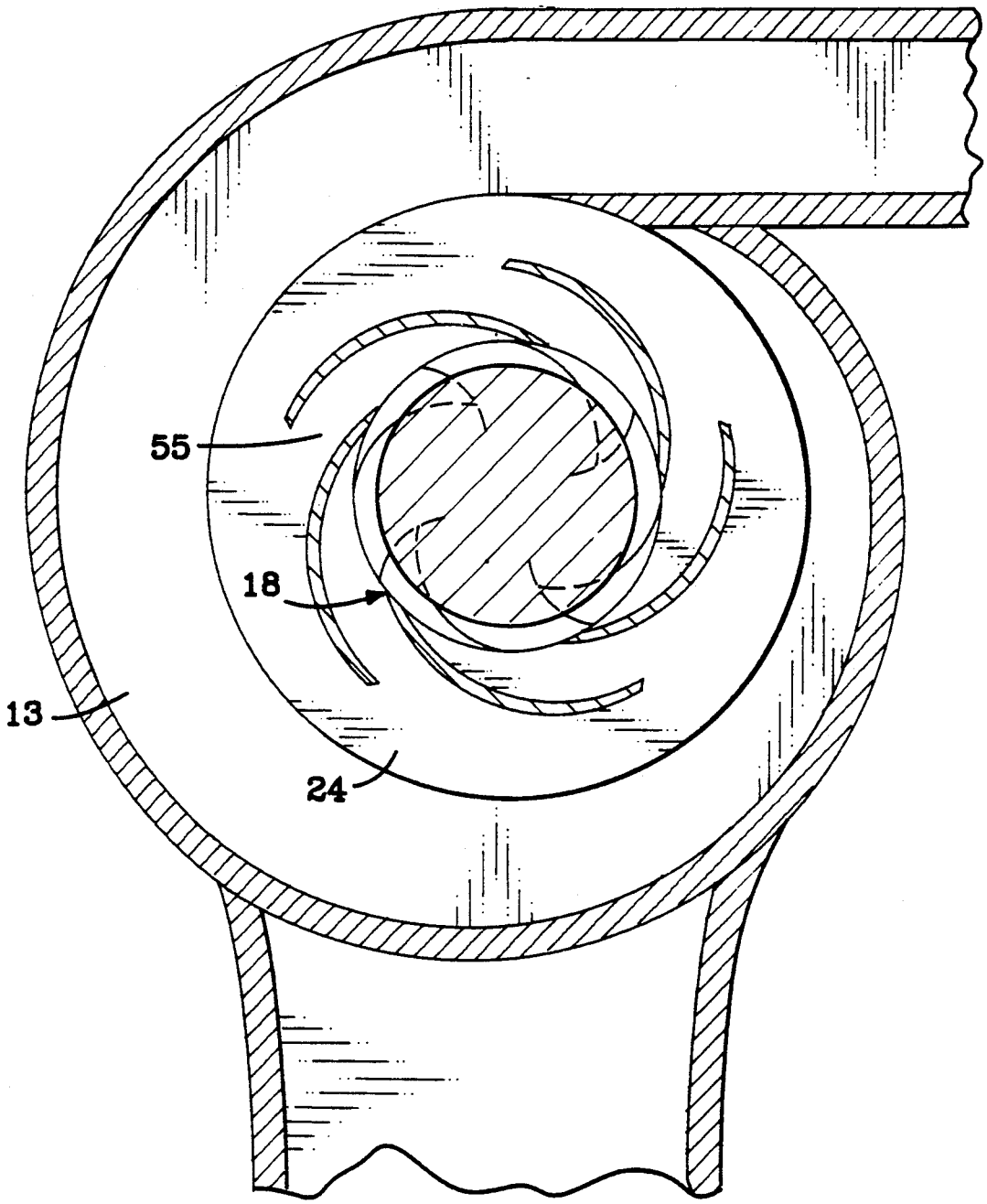
FIG. 3 is a fragmentary view along line 3—3 of the pump embodied in FIG. 1.

FIG. 3 shows a fragmentary schematic sectional view of the rotor and housing along line 3—3 of FIG. 1. Vanes 21 are attached to shroud 15. Inducer assembly 18 feeds fluid to the impeller blades which pump it radially outward through pumping channels 55 defined by blades 21 and shrouds 15. Diffuser 24 is defined by that space between the two shrouds 15 radially outside that which is occupied by blades 21. Pressurized fluid from diffuser 24 is carried away through volute 13.

The particular design parameters for a given pumping application are determined by pressure and volume requirements, space constraints, working fluid properties, and desired orientation of inlet and discharge ports. These are the considerations that determine the diameter of the impeller shrouds 15, the spacing between the shrouds and consequently the width of the impeller blades 21, the size of diffuser 24 if needed, the size of inducer assembly 18, and the size and shape of the pump housing 10 and recirculation passages 20 which are provided to assure smooth inducer action at off-design flow rates. Stators 14 and impeller shrouds 15 are matched according to pumping power requirements. Stators 14 may or may not be encapsulated in cans 17, depending upon whether the working fluid is compatible with the stators.

This invention provides an integrated centrifugal pump and motor having the advantages of compactness, the ability to operate electronically at variable speeds, a shaftless rotor which requires no seals, non-contact radial bearing supports during operation, and hydrodynamic axial thrust balance for the rotor. These advantages are obtained when pumping either compressible or incompressible fluids.

Having described the invention, what is claimed is:

1. A centrifugal pump comprising:

a housing having an internal chamber with inlet and discharge ports;

an impeller supported in said chamber for rotation about an axis, the impeller having a hub section having an axis about which it may rotate to pump a working fluid, the impeller having a central opening; first and second disk shaped shrouds supported from said tub section, at least one of said shrouds containing permanent magnets; and a plurality of pumping channels defined by a plurality of impeller blades projecting outwardly from the hub section in a common plane between said first and second shrouds so as to rotate in a common plane normal to said axis;

a motor stator coil for rotatably driving said impeller, the stator coil being disposed adjacent said shrouds so as to form a gap between the stator coil and the shroud for receiving a small quantity of pumped working fluid, the stator coil further having a central opening therein, the working fluid passing through the stator coil central opening and through the impeller central opening;

a means for axial hydrodynamic balancing of said impeller, the means comprising a ring disposed in said gap for restricting the flow of the small quantity of pumped working fluid;

a means for inducing flow of a working fluid toward the pumping channels from opposite directions, the means for inducing flow of a working fluid to the pumping channels comprising an opening between the hub section and each shroud and an inducer in the opening, the inducer comprising a pumping member which is separate from the impeller; and a recirculation passage adjacent each inducer.

2. A centrifugal pump comprising:

a housing having an internal chamber with inlet and discharge ports;

an impeller supported in said chamber for rotation about an axis, the impeller having a hub section; at least one disk shaped shroud containing permanent magnets;

a plurality of pumping channels defined by a plurality of impeller blades projecting outwardly from the hub section and fixed to a face of the shroud; and means for supplying fluid to the pumping channels, said means comprising at least one opening between the hub section and the shroud; and one or more inducers in said opening, said inducers comprising pumping members which are separate from the impeller blades; and a recirculation passage adjacent each inducer.

3. A centrifugal pump comprising:

a housing having an internal chamber connecting inlet and discharge ports;

a disk shaped impeller having permanent magnets disposed therein, said impeller being supported within said chamber for rotation about an axis to pump a working fluid;

a motor stator coil for rotatably driving said impeller, said stator coil being disposed at a side of said impeller so as to form a gap between the stator coil and the impeller for receiving a small quantity of pumped working fluid; and a means for axial hydrodynamic balancing of said impeller, the means comprising a ring disposed in said gap for restricting flow of the small quantity of pumped working fluid therethrough.

4. A centrifugal pump as claimed in claim 3 and further comprising a second motor stator coil and a second ring, said impeller being disposed between the first and second motor stator coils and said second ring being disposed in a second gap between said second motor stator coil and said impeller for restricting the flow of pumped working fluid therethrough.

* * * * *